US005791935A

United States Patent [19]

Yamanashi

[11] Patent Number: 5,791,935

[45] Date of Patent: Aug. 11, 1998

[54] CONNECTOR WITH A FITTING-COMPLETION DETECTOR

[75] Inventor: Makoto Yamanashi, Shizuoka, Japan

[73] Assignee: Yazaki Corporation, Tokyo, Japan

[21] Appl. No.: 674,602

[22] Filed: Jun. 28, 1996

[30] Foreign Application Priority Data

Jun. 30, 1995 [JP] Japan ..... 7-166480

[51] Int. Cl.[6] ..... H01R 3/00

[52] U.S. Cl. ..... 439/489; 439/544

[58] Field of Search ..... 439/345, 350, 439/354, 357, 488, 489, 544, 552, 557

[56] References Cited

U.S. PATENT DOCUMENTS 5,507,665 4/1996 Oda ..... 439/489

5,605,472 2/1997 Sakai et al. ..... 439/489

FOREIGN PATENT DOCUMENTS 1-174881 12/1989 Japan .

4-174983 6/1992 Japan .

*Primary Examiner*—Khiem Nguyen

*Attorney, Agent, or Firm*—Finnegan, Henderson, Farabow, Garrett & Dunner, L.L.P.

[57] ABSTRACT

A connector is provided which is mounted in a hole in a structure such as an automotive door and with an easy-to-handle fitting-completion detector with which whether connector housings are fitted to each other can be reliably checked. The fitting-completion detector (3) is mounted on one connector housing (1), with locking claws of its holding arms (13) engaged in locking grooves (7) in the one connector housing. The other connector housing (2) is provided with sloped release projections 11 that advance into respective locking grooves (7). The fitting-completion detector includes insertion prevention portions (14, 14'). While the connector housings are not being fitted together, owing to the insertion prevention portions (14, 14'), the one connector housing is prevented from entering the hole. When the connector housings are fitted, the release projections (11) slidingly contact respective locking claws (13*a*) to move the holding arms (13, 13') outwardly until the fitting-completion detector (3) is disengaged, at which time it is removable.

3 Claims, 5 Drawing Sheets

CONNECTOR WITH A FITTING-COMPLETION DETECTOR

BACKGROUND OF THE INVENTION

1. Field of the Invention

This invention relates to a fitting-completion detecting mechanism for connectors used in automotive electric wiring and installed inside a structure such as an automotive door or the like.

2. Description of the Related Art

Connectors have been proposed which have devices for detecting if mating connector housings are completely fitted. For example, a connector with a locked-coupling detecting device such as shown in FIG. 6 is proposed in Japanese Patent Application Laid-Open Specification No. Hei 4-174983.

This connector comprises a male connector housing a, a female connector housing b and a locked-coupling detector c. Locked-coupling detector c, as shown in FIG. 7, is locked in advance by resilient locking pieces d to a rear portion of male connector housing a to extend rearwardly.

When male and female connector housings a and b are fitted as shown in FIG. 8, releasing projections e on female connector housing b contact locking projections d1 of resilient locking pieces d to displace the latter outwardly and make locked-coupling detector c removable. Thus, the complete coupling of both connector housings a and b is confirmed through removal of locked-coupling detector c.

It is to be noted that, to make a connection between automotive on-body electric wiring and in-door electric wiring, a connector is conventionally mounted in a receiving hole provided in a structure such as an automotive body or door, the connector being provided with a waterproofing member such as a grommet for encircling and protecting its electric wires. Such a locked-coupling detector c, however, is not suitable for use with a connector installed in such a structure, because due to the manner in which the detector c is locked to the rear portion of male connector housing a, the detector-removal direction coincides with the coupling direction of connector housings a and b, making it extremely difficult to remove the detector c in case the connector is received in a limited space inside the structure.

A connector with a fitting-completion confirming mechanism such as shown in FIG. 10 is also proposed in Japanese Utility Model Application Laid-Open Specification No. Hei 1-174881, which comprises a male connector housing a', a female connector housing b' and a fitting-completion confirming member c'.

Fitting-completion confirming member c', as shown in FIG. 11, is maintained in a projected state on female connector housing b' when connector housings a' and b' are not fitted to each other, and, as shown in FIG. 12, adapted to be pressed down and received inside female connector housing b' when connector housings a' and b' are fitted.

In the case where such a fitting-completion confirming member c' is used with a connector mounted in a structure hole, the height by which fitting-completion confirming member c' projects when connector housings a' and b' are not fitted, should be large. Otherwise, an error may arise that an operator forgets to press down the confirmation member c', and allows both connector housings to be received into the structure hole without being completely fitted to each other.

However, if the projected height of the confirming member c' is made large so that when connector housings a' and b' are not fitted, the confirming member c' abuts against the circumference of the structure hole, and prevents female connector housing b' from being received into the hole, it requires a large space inside female connector housing b' for receiving the confirming member c' on fitting the connector housings together, resulting in the size of female connector housing b' enlarged.

SUMMARY OF THE INVENTION

This invention has been accomplished to overcome the above drawbacks and an object of this invention is to provide a connector with a reliable fitting-completion detector which can be easily handled, which serves to realize small-sized connectors, and which enables secure checking if connector housings are mutually fitted.

In order to attain the object, a connector with a fitting-completion detector, which connector is mountable in a receiving hole in a structure, comprises: a first connector housing including a hood portion, a second connector housing insertable into the hood portion to be fitted to the first connector housing, the hood portion having on opposite sides thereof engagement grooves each extending from a front end thereof inwardly in a fitting direction of the first and second connector housings, the second connector housing having on opposite sides thereof release projections each with a sloped surface and engageable into a respective one of the engagement grooves when the first and second connector housings are fitted to each other; and a fitting-completion detector including a central portion and a pair of opposed holding arms extending parallel at opposite ends of the central portion, the holding arms being at free ends thereof provided with inwardly-directed locking claws adapted to engage in the engagement grooves to lock the fitting-completion detector on the first connector housing, the fitting-completion detector further including prevention means for preventing the first connector housing from entering the receiving hole when the detector is on the first connector housing, wherein when the first and second connector housings are fitted to each other, the release projections on the second connector housing advance into the respective engagement grooves in the first connector housing to bring the sloped surfaces into sliding contact with the locking claws therein to move the holding arms of the fitting-completion detector outwardly until the holding arms are disengaged from the engagement grooves, at which time the fitting-completion detector is removable from the first connector housing, so that completion of fitting of the first and second connector housings may be known and the connector may be inserted into the receiving hole in the structure.

With the connector with the fitting-completion detector according to this invention, the fitting-completion detector is moved perpendicular to the fitting direction of the first and second connector housings to be mounted on the first connector housing, and thus, also moved perpendicular thereto to be removed on completion of the fitting of the connector housings, leading to an easy handling of the fitting-completion detector even in the case where the connector is disposed in a limited small space.

Further, since the fitting-completion detector is removably mounted on the first connector housing, the prevention means thereon for preventing the advancement of the connector housing into the receiving hole in the structure may be made large. In other words, if removed after completion of the fitting of the first and second connector housings, the connector can be mounted into the receiving hole without any difficulty. The large-sized prevention means serves to help an operator to exclude an error in working.

The above and other objects, features and advantages of this invention will become apparent from the following description and the appended claims, taken in conjunction with the accompanying drawings in which like parts or elements are denoted by like reference characters.

DESCRIPTION OF THE PREFERRED EMBODIMENT

Embodiments of this invention will now be described with reference to the attached drawings.

Figure 1:
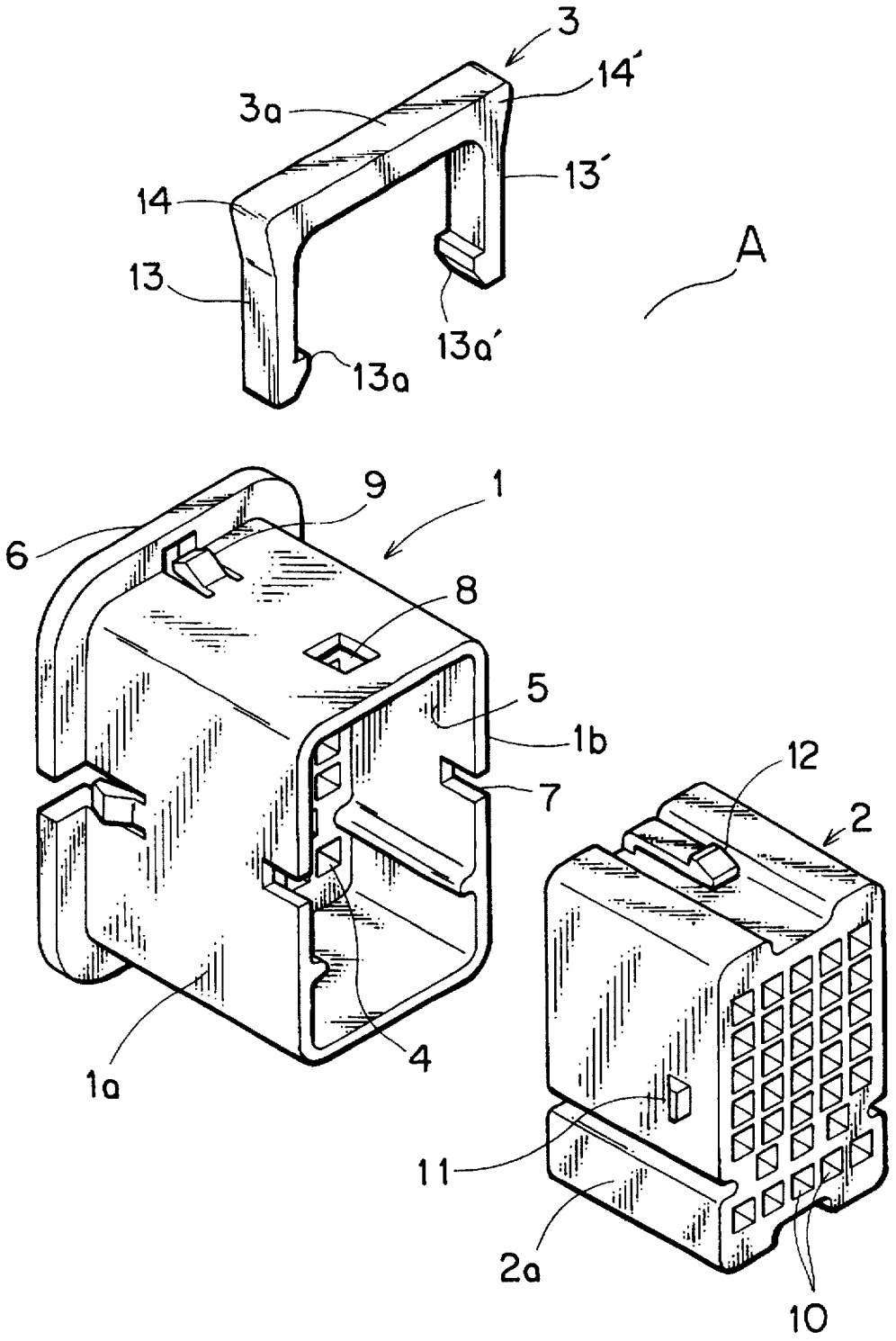
FIG. 1 is an exploded view of a connector with a fitting-completion detector according to one embodiment of this invention.

Referring to FIG. 1, connector A comprises a female connector housing 1 formed by molding an electrically-insulating synthetic resin material, a male connector housing 2 and a fitting-completion detector 3 mounted on female connector housing 1.

Female connector housing 1 has a plurality of terminal-accommodating chambers 4 formed inside its peripheral wall la, each of the chambers 4 containing a male terminal (not shown). The peripheral wall la of female connector housing 1 is extended forwardly by a hood portion 5 for receiving therein male connector housing 2. Female connector housing 1 is at the rear end provided with an oval flange 6 for mounting the housing 1 in a hole in a structure.

Engagement grooves 7, 7 are formed on opposite lateral sides of peripheral wall 1*a*, which grooves extend inwardly in a fitting direction of the connector housings from the front end of peripheral wall 1*a*. In the upper portion of the peripheral wall la defining hood portion 5, an engagement hole 8 is formed for engagement by male connector housing 2 to lock the same in position. At upper and lower portions of peripheral wall la towards the rear end, locking arms 9, 9 are provided for coupling the connector housing to the structure.

Male connector housing 2 has a peripheral wall 2*a* of such configuration as to fit into hood portion 5 of female connector housing 1 and a plurality of terminal-accommodating chambers 10 formed inside periphral wall 2*a*, each of the terminal-accommodating chambers 10 containing a female terminal (not shown) for fitting with a respective male terminal in male connector housing 1.

On opposite lateral sides of male connector housing 2, release projections 11 each with a sloped surface 11*a* are provided for engagement into respective engagement grooves 7, 7 of female connector housing 1. On the upper portion of peripheral wall 2*a*, a resilient locking piece 12 is provided for engagement in engagement hole 8 of female connector housing 1.

A fitting-completion detector 3 has a U-shaped configuration and comprises a central portion 3a and a pair of opposed holding arms 13, 13' extending parallel at opposite ends of the central portion 3a. Each holding arm 13, 13' is at its free end provided with an inwardly-directed locking claw 13*a*, 13*a*'. The central portion 3*a* is at opposite ends bulged to form insertion prevention portions 14, 14', whereby the central portion 3*a* has a greater width than that of the receiving hole in a structure and is prevented from advancing thereinto.

The operation of fitting-completion detector 3 will now be described.

Figure 2:
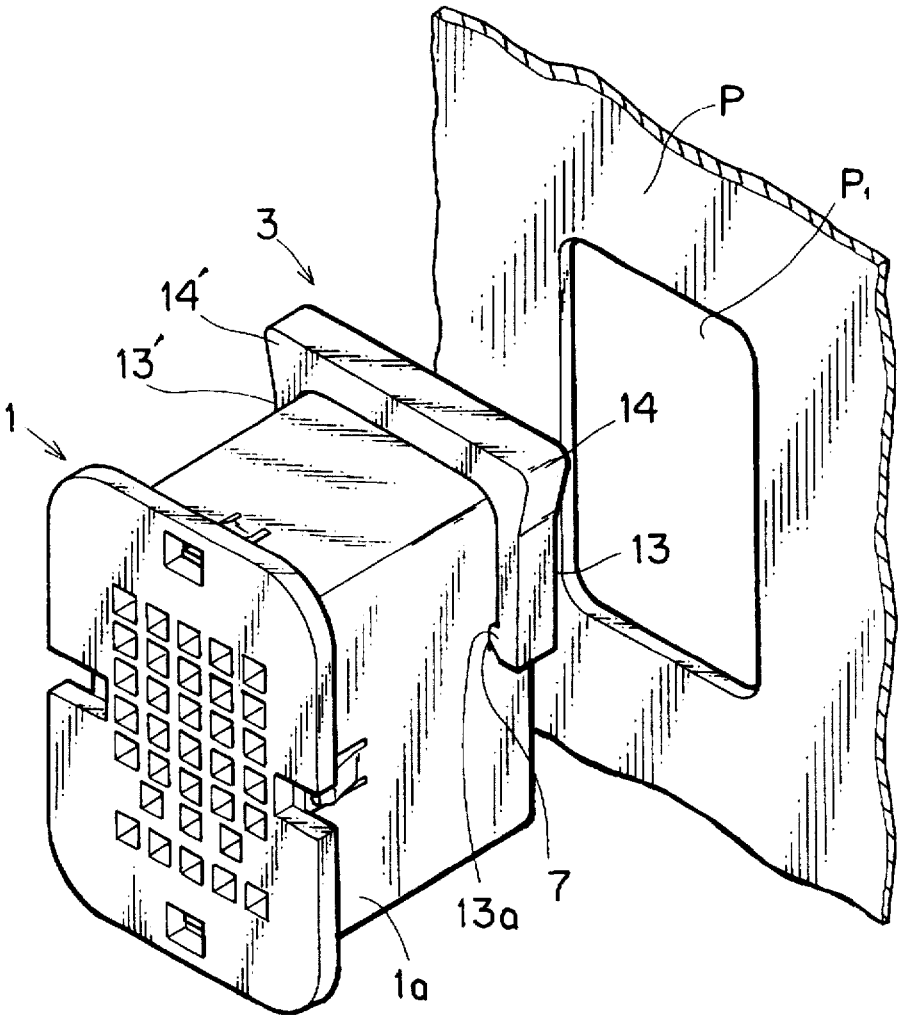
FIG. 2 is a perspective view of a female connector housing in FIG. 1, with the fitting-completion detector mounted thereon.

Fitting-completion detector 3 is in advance mounted on female connector housing 1 as shown in FIG. 2, in such manner as to ride on female connector housing 1, with its locking claws 13*a*, 13*a*' (only 13*a* shown) engaged in engagement grooves 7 on opposite sides of the housing 1. Female connector housing 1 with fitting-completion detector 3 mounted thereon as described in the above cannot be inserted into hole P1 in structure P, insertion prevention portions 14, 14' abutting against the circumference of P1 and preventing the housing 1 from being erroneously inserted thereinto.

Figure 3:
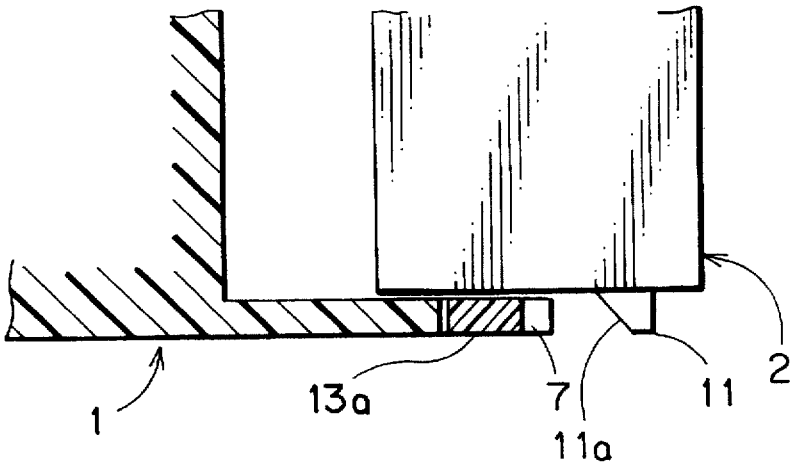
FIG. 3 is a view showing locking claws of the fitting-completion detector in FIG. 2 and release projections on the male connector housing.
Figure 4:
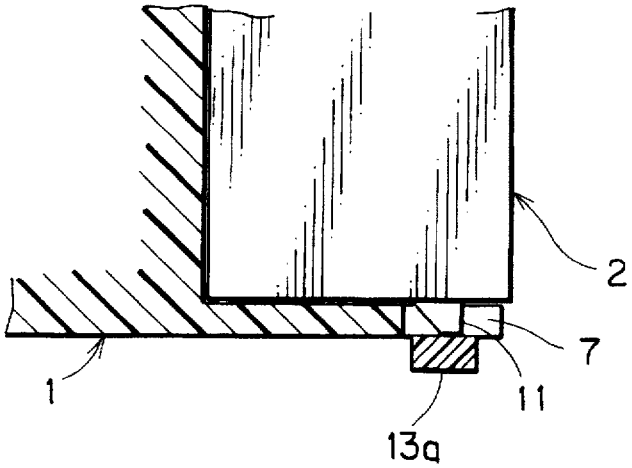
FIG. 4 is an explanatory view of the operation of the release projections on the male connector housing in FIG. 3, whereby the locking claws have been displaced.
Figure 9:
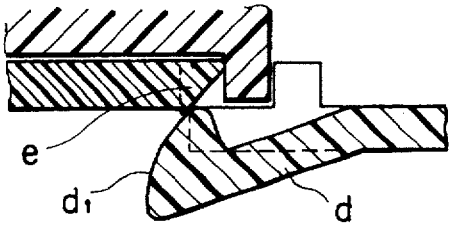
FIG. 9 is an explanatory view showing resilient locking pieces and engagement release projections in FIG. 6, shown in operation.
Figure 10:
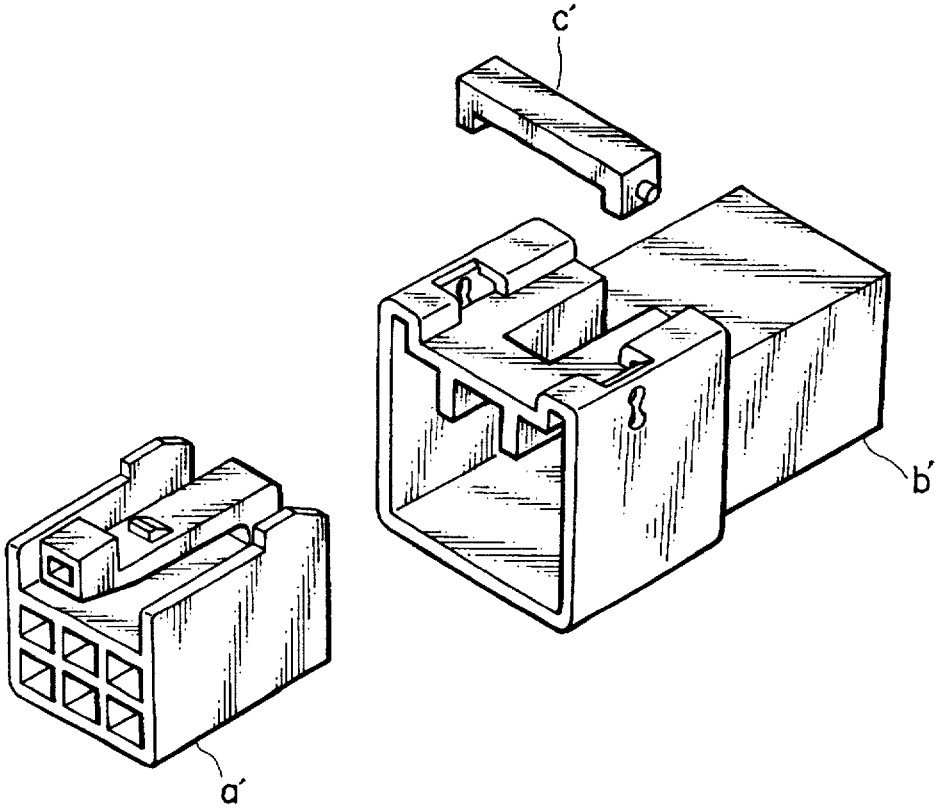
FIG. 10 is an exploded view of another conventional connector with a fitting-completion confirming mechanism.

If male connector housing 2 is fitted into female connector housing 1, as shown in FIGS. 3 and 4, release projections 11 on male connector housing 2 advance into respective engagement grooves 7 of female connector housing 1 to bring sloped surface 11*a* of release projection 11 into sliding contact with locking claw 13*a* of fitting detector 3 and move the latter outwardly.

When locking claws 13*a*, 13*a*' are moved outwardly and disengaged from respective engagement grooves 7, fitting detector 3 can be removed from female connector housing 1. When fitting detector 3 is removed, an operator can know that connector housings 1 and 2 have been fully fitted to each other. Further, since female connector housing 1 is mountable in hole P1 in structure P only when fitting detector 3 has been removed, mounting connectors with their connector housings incompletely fitted can be excluded.

Figure 5:
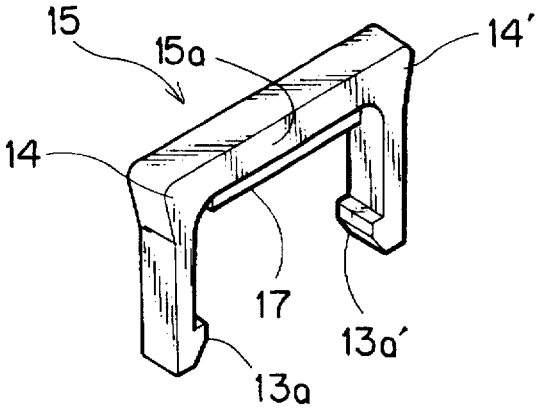
FIG. 5 is a perspective view of a fitting-completion detector and a female connector housing according to another embodiment of this invention.
Figure 5:
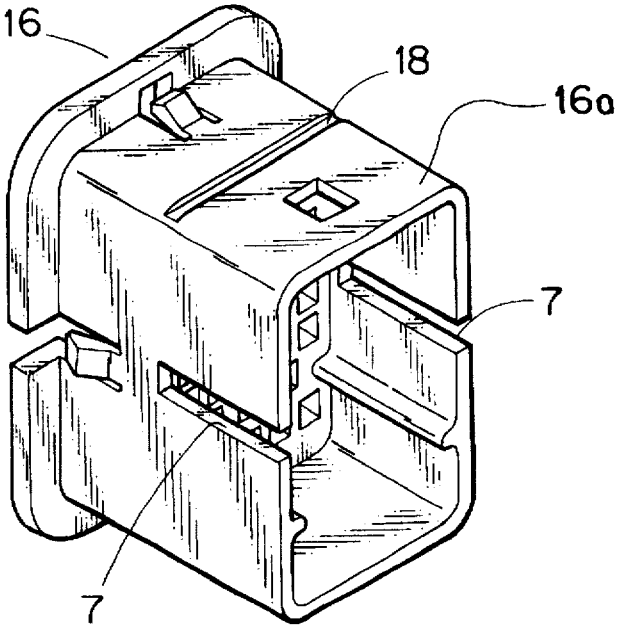
Figure 12:
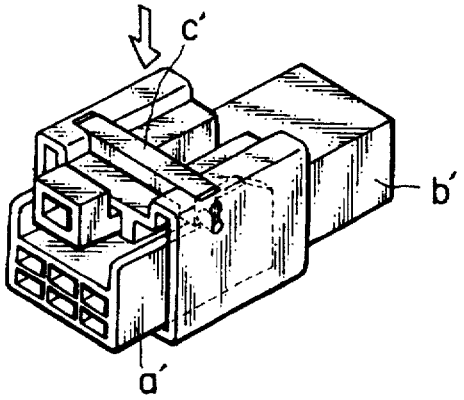
FIG. 12 is an explanatory view showing the connector housings in FIG. 10 in a mutually fitted state, with the fitting-completion confirming member received into the female connector housing.
Figure 6:
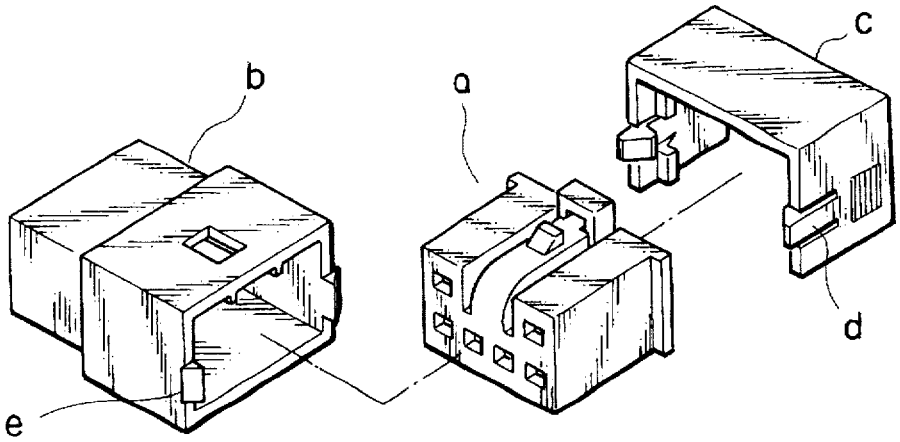
FIG. 6 is an exploded view of a conventional connector with a locked-coupling detector device.
Figure 7:
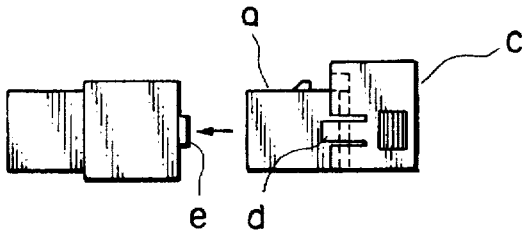
FIG. 7 is a view of a male connector housing in FIG. 6, with the locked-coupling detector device mounted thereon.
Figure 8:
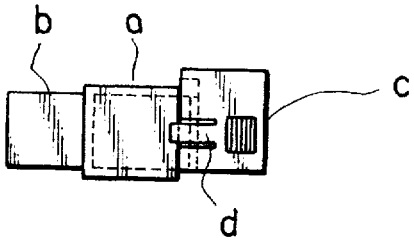
FIG. 8 is an explanatory view showing the connector housings in FIG. 7 in a mutually-fitted state.
Figure 11:
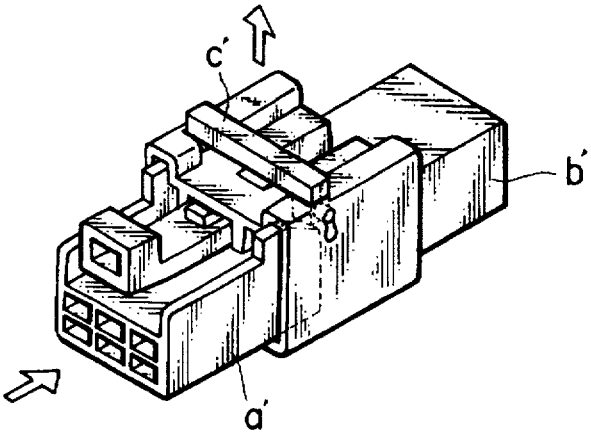
FIG. 11 is an explanatory view showing the connector housings in FIG. 10 in a mutually not-fitted state, with the fitting-completion confirming member projected on the female connector housing.

FIG. 5 is a perspective view of a fitting-completion detector 15 and a female connector housing 16 according to another embodiment of this invention.

Fitting-completion detector 15 differs from fitting-completion detector 3 as mentioned above in that it is at the inner side of its central portion 15*a* provided with a positioning projection 17 for positioning fitting-completion detector 15 in position on female connector housing 16.

Fitting-completion detector 15 is in other respects identical with fitting detector 3.

Female connector housing 16 differs from female connector housing 1 as mentioned above in that it is in the upper portion of its peripheral wall 16a provided with an engagement groove 18 for engagement therein of positioning projection 17 of fitting-completion detector 15. Female connector housing 16 is in other respects identical with female connector housing 1.

Fitting-completion detector 15 is mounted on female connector housing 16, with its positioning projection 17 engaged in the engagement groove 18 and locking claws 13*a*, 13*a*' of its holding arms 13 engaged in respective engagement grooves 7.

Owing to the positioning projection 17 provided on fitting-completion detector 15, which is supported in engagement groove 18, fitting-completion detector 15 is stably held on female connector housing 16. Further, since the position whereat fitting-completion detector 15 is mounted on female connector housing 16 is limited, it becomes unlikely that an operator mounts fitting-completion detector 15 at an erroneous position on female connector housing 16, resulting in an improvement in working efficiency.

Having now fully described the invention, it will be apparent to one of ordinary skill in the art that many changes and modifications can be made thereto without departing from the spirit and scope of the invention as set forth herein.

What is claimed is:

1. A connector with a fitting-completion detector, which connector is mountable in a receiving hole in a structure, comprising:

a first connector housing including a hood portion, a second connector housing insertable into said hood portion to be fitted to said first connector housing, said hood portion having on opposite sides thereof engagement grooves each extending from a front end thereof inwardly in a fitting direction of said first and second connector housings, said second connector housing having on opposite sides thereof release projections each with a sloped surface and engageable into a respective one of said engagement grooves when said first and second connector housings are fitted to each other; and a fitting-completion detector including a central portion and a pair of opposed holding arms extending parallel at opposite ends of said central portion, said holding arms being at free ends thereof provided with inwardly-directed locking claws adapted to engage in said engagement grooves to lock the fitting-completion detector on said first connector housing, said fitting-completion detector further including prevention means for preventing said first connector housing from entering said receiving hole when the detector is on said first connector housing, wherein when said first and second connector housings are fitted to each other, said release projections on said second connector housing advance into the respective engagement grooves in said first connector housing to bring said sloped surfaces into sliding contact with said locking claws therein to move said holding arms of said fitting-completion detector outwardly until said holding arms are disengaged from said engagement grooves, at which time said fitting-completion detector is removable from said first connector housing, so that completion of fitting of said first and second connector housings may be known and said connector may be inserted into said receiving hole in the structure.

2. A connector according to claim 1, wherein said prevention means comprises bulged portions at opposite lateral ends of said central portion of the fitting-completion detector.

3. A connector according to claim 1, wherein said fitting-completion detector is on an inner side thereof provided with a positioning projection, and said first connector housing is on an upper wall thereof provided with an engagement groove for receiving therein said positioning projection of said fitting-completion detector.

* * * * *